US008708645B1

(12) United States Patent
Liang

(10) Patent No.: US 8,708,645 B1
(45) Date of Patent: Apr. 29, 2014

(54) TURBINE ROTOR BLADE WITH MULTI-VORTEX TIP COOLING CHANNELS

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 378 days.

(21) Appl. No.: 13/279,752

(22) Filed: Oct. 24, 2011

(51) Int. Cl.
*F01D 5/20* (2006.01)

(52) U.S. Cl.
USPC ..... 415/173.1; 416/92

(58) Field of Classification Search
USPC ..... 415/115, 171.1, 173.1, 173.4, 173.5, 415/175, 176; 416/90 R, 92, 96 A, 96 R, 416/97 R, 224, 236 A, 236 R
See application file for complete search history.

(56) References Cited

U.S. PATENT DOCUMENTS

| | | | | |
|---|---|---|---|---|
| 4,390,320 | A * | 6/1983 | Eiswerth | 416/97 R |
| 6,059,530 | A * | 5/2000 | Lee | 416/97 R |
| 7,118,326 | B2 * | 10/2006 | Liang | 415/115 |
| 8,133,032 | B2 * | 3/2012 | Tibbott et al. | 416/235 |
| 8,277,171 | B2 * | 10/2012 | Kopmels | 415/115 |
| 2012/0201695 | A1 * | 8/2012 | Little | 416/97 R |

* cited by examiner

*Primary Examiner* — Edward Landrum
*Assistant Examiner* — Jason Fountain
(74) *Attorney, Agent, or Firm* — John Ryznic

(57) ABSTRACT

A turbine rotor blade with a tip section having a pressure side and suction side tip rail that forms a squealer pocket. A number of chordwise extending ribs formed within the squealer pocket form vortex cooling channels that extend from the leading edge region and open along the pressure side tip peripheral wall. A row of tip cooling holes opens into each of the vortex cooling channels to discharge cooling air and form a vortex flow within the channels that provides both sealing and cooling for the blade tip.

7 Claims, 7 Drawing Sheets

TURBINE ROTOR BLADE WITH MULTI-VORTEX TIP COOLING CHANNELS

CROSS-REFERENCE TO RELATED APPLICATIONS

None.

GOVERNMENT LICENSE RIGHTS

None.

BACKGROUND OF THE INVENTION

1. Field of the Invention

The present invention relates generally to a gas turbine engine and more specifically to a turbine rotor blade with blade tip cooling.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

Turbine rotor blades rotate within the engine casing and therefore form a gap with a stationary part of the turbine such as a blade outer air seal (BOAS). As the turbine heats up or cools down, the blade tip gap can change from positive to a negative value. The negative value for the blade tip gap is when tip rubbing occurs. The blade tip gap allows for hot gas to leak through and over the blade tip. The leakage flow exposes the blade tip to high temperature that can cause erosion and thus decreased turbine performance and shorter life for the blades. Blade tips are thus cooled using cooling air from the internal blade cooling circuit to limit damage to the blade tip from the high temperatures.

In the prior art, blade tip cooling is produced by drilling holes into the upper ends of the serpentine flow cooling circuit from both the pressure and suction surfaces near to the blade tip edge and the top surface of a squealer cavity. Film cooling holes are formed along the airfoil pressure side and suction side tip sections and extend from the leading edge to the trailing edge to provide cooling of the squealer tip rails. Since the blade tip region is subject to severe secondary flow field, a large number of film cooling holes and a large amount of cooling air flow are required to adequately cool the blade tip periphery. FIG. 1 shows a prior art turbine rotor blade tip with a squealer pocket and the secondary flow and cooling air pattern that forms. FIG. 2 shows the prior art blade with a row of pressure side tip periphery film cooling holes. FIG. 3 shows the film hole break-out shape for the row of film holes in FIG. 2. FIG. 4 shows the prior art blade with a row of suction side tip periphery film cooling holes.

The blade squealer tip rails are subject to heating from three exposed sides: heat load from the airfoil hot gas side surface of the tip rail; heat load from the top portion of the tip rail; and heat load from the back side of the tip rail. Cooling of the squealer pocket is performed by film cooling holes along the blade pressure and suction side periphery and conduction through the base region of the squealer pocket becomes ineffective. This is primarily due to the combination of squealer pocket geometry and the interaction of the hot gas secondary flow mixing. Thus, the effectiveness of the pressure side film cooling and tip section convective cooling holes is very limited. In addition, a TBC is normally used in the industrial engine turbine blades in order to reduce the blade metal temperature. However, applying the TBC around the blade tip rails without effective backside convection cooling may not reduce the blade tip rail metal temperature. FIG. 5 shows a prior art blade tip section cooling design with a cooling air supply channel 11, pressure side film cooling holes 12, suction side film cooling holes 13, tip rails that form a squealer pocket 14, and tip cooling holes 15 that open into the squealer pocket 14. A thermal barrier coating (TBC) 16 is applied on the walls and the tip floor. A high temperature turbine blade tip section heat load is a function of the blade tip leakage flow. A high leakage flow will induce a high heat load onto the blade tip section. Therefore, the blade tip section sealing and cooling must be addressed as a single problem.

BRIEF SUMMARY OF THE INVENTION

A turbine rotor blade with a tip section having a pressure side and suction side tip rail that forms a squealer pocket. A number of chordwise extending ribs formed within the squealer pocket form vortex cooling channels that extend from the leading edge region and open along the pressure side tip peripheral wall. A row of tip cooling holes opens into each of the vortex cooling channels to discharge cooling air and form a vortex flow within the channels that provides both sealing and cooling for the blade tip.

DETAILED DESCRIPTION OF THE INVENTION

Figure 1:
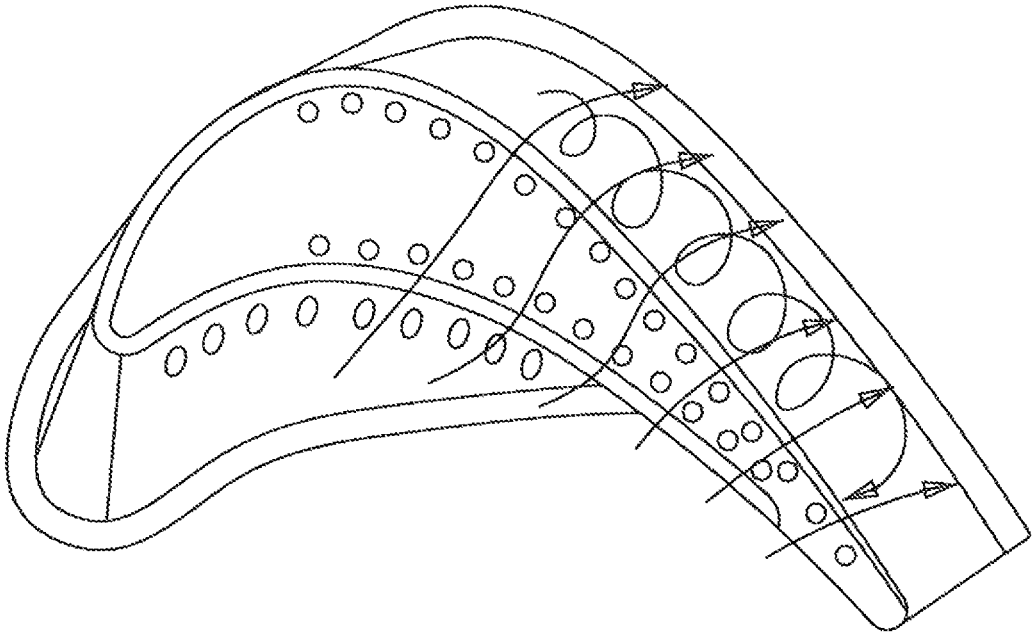
FIG 1 Prior Art
FIG. 1 shows a prior art turbine rotor blade tip section with a squealer pocket.
Figure 2:
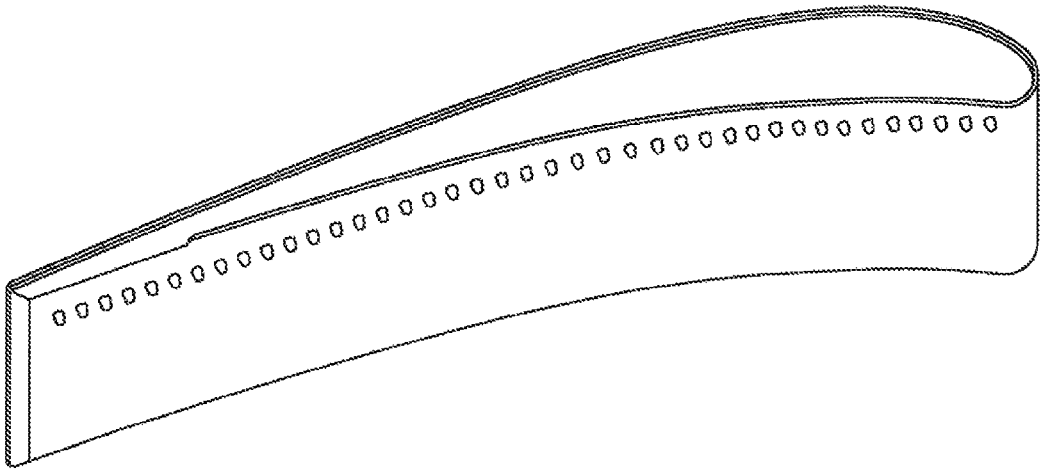
FIG 2 Prior Art
FIG. 2 shows the prior art blade with a row of film cooling holes on the pressure side wall under the tip rail.
Figure 3:
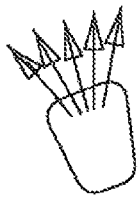
FIG 3 Prior Art
FIG. 3 shows a break-out pattern for the film holes of FIG. 2.
Figure 4:
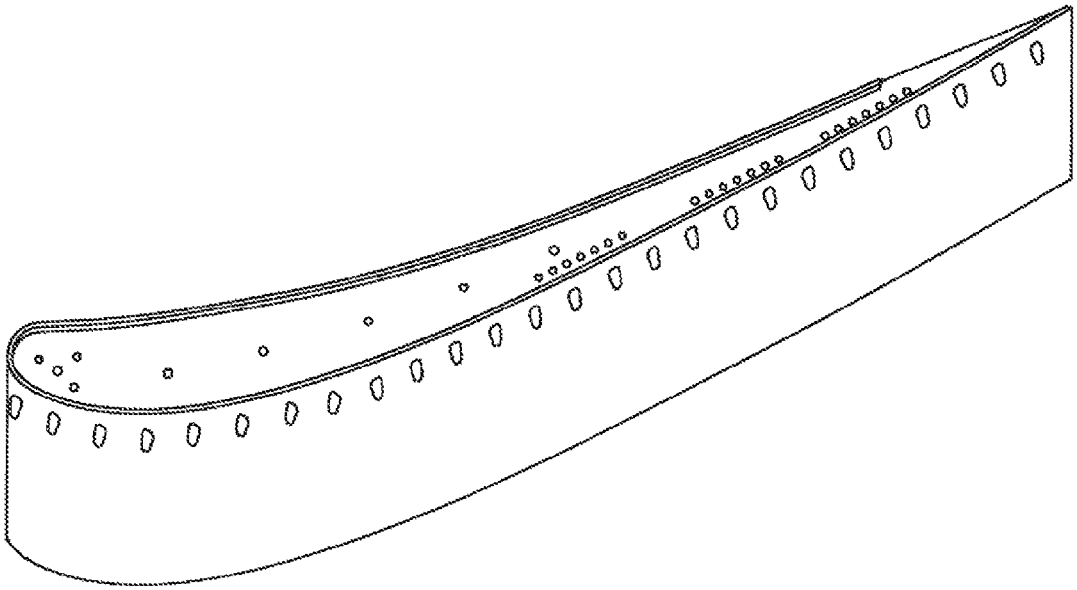
FIG 4 Prior Art
FIG. 4 shows the prior art blade with a row of film cooling holes on the suction side wall under the tip rail.
Figure 5:
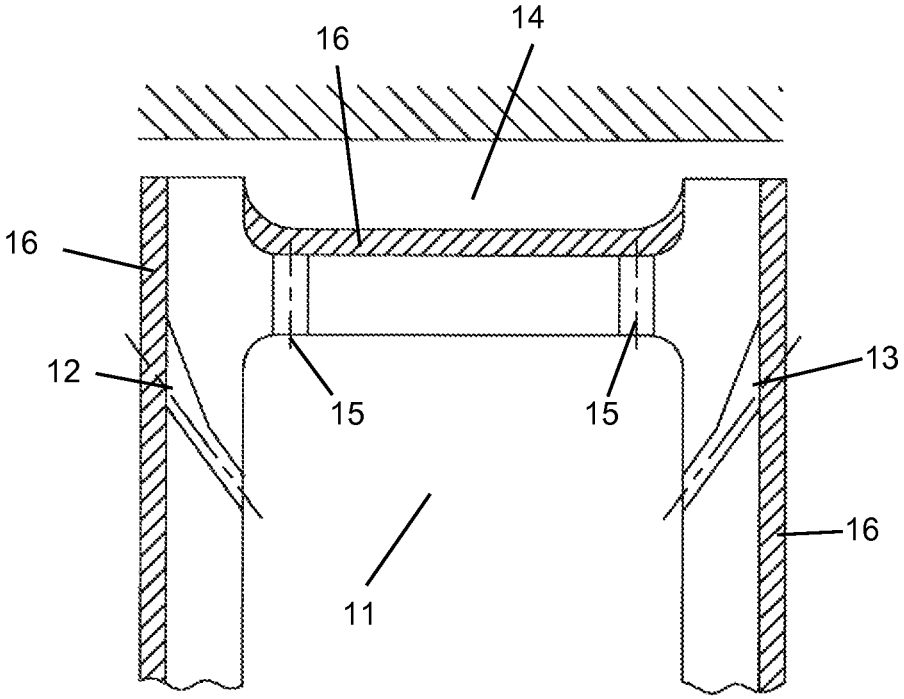
FIG 5 Prior Art
FIG. 5 shows a cross section view of the prior art blade with the tip region cooling circuits.
Figure 6:
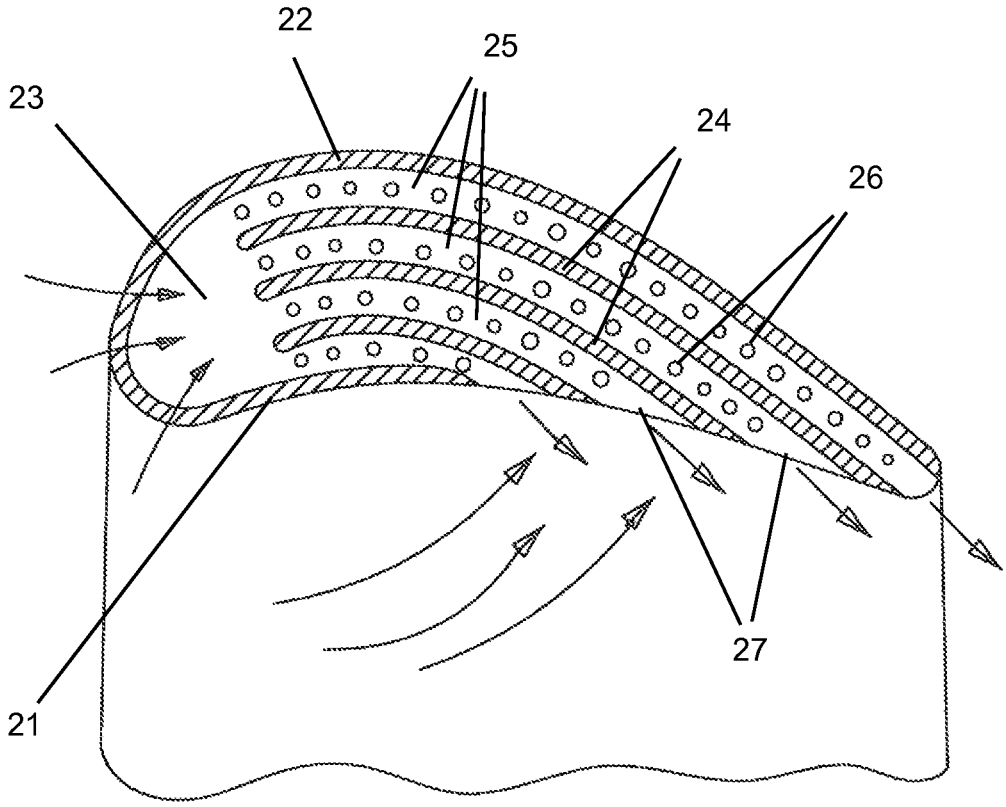
FIG. 6 shows a perspective view of a blade tip with the cooling circuit of the present invention.

The turbine rotor blade of the present invention includes a blade tip region cooling circuit as seen in FIG. 6. The blade tip includes a pressure side tip rail 21 and a suction side tip rail 22 that merges together in the leading edge region to form one continuous tip rail. The tip rails 21 and 22 form a squealer pocket 23. A number of chordwise extending ribs 24 are formed within the squealer pocket 23 that extends from adjacent to a leading edge region and end along the pressure side wall. The ribs 24 form vortex cooling channels 25. Each vortex cooling channel 25 includes a row of tip cooling holes 26 that are connected to a cooling supply channel formed within the airfoil section of the blade. Each of the vortex cooling channels 25 extends from the leading edge region of the squealer pocket 23 and opens on the blade pressure side tip peripheral wall to discharge the spent cooling air for use to prevent the hot gas leakage from the blade pressure side and over the blade tip to the suction side.

Figure 7:
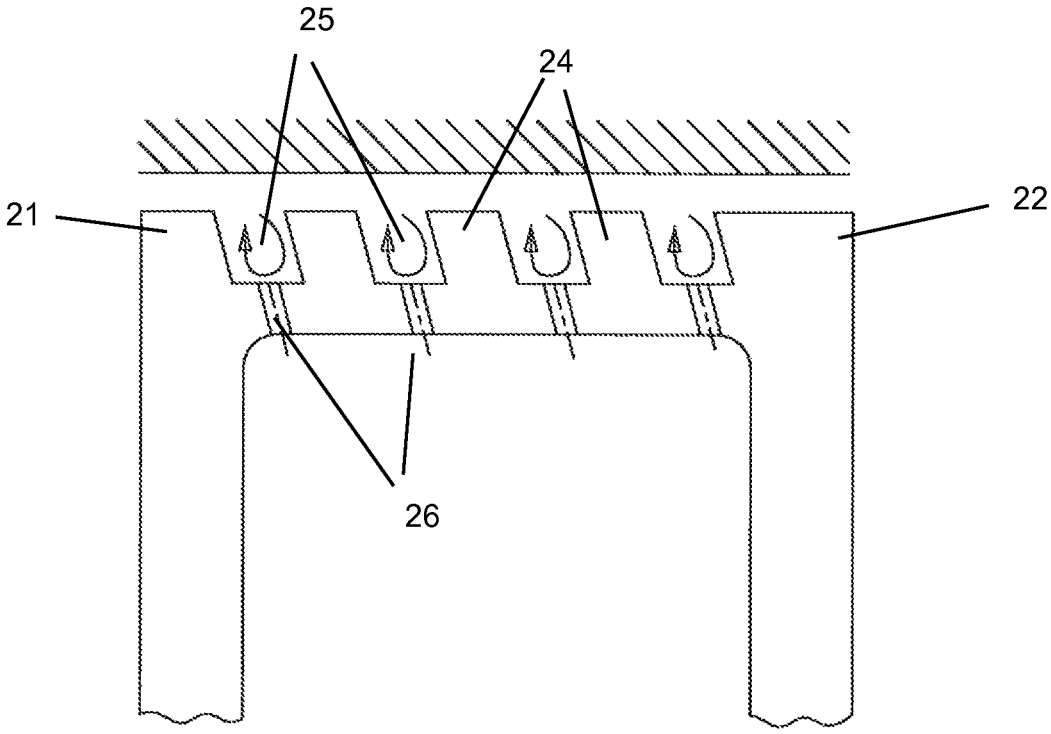
FIG. 7 shows a cross section view of the blade tip cooling circuit of the present invention.

FIG. 7 shows a cross section view of the blade tip cooling circuit of the present invention. The pressure side tip rail 21 and the suction side tip rail 22 form the squealer pocket. A number of the vortex cooling channels 25 are formed by the tip rails and the ribs 24. The tip rails 21 and 22 and the ribs 24 have the same radial height. The tip cooling holes 26 connect the cooling air supply cavity to the vortex channels 25. In the FIG. 7 embodiment, the tip cooling holes 26 open onto a middle of the vortex channels 25.

Figure 8:
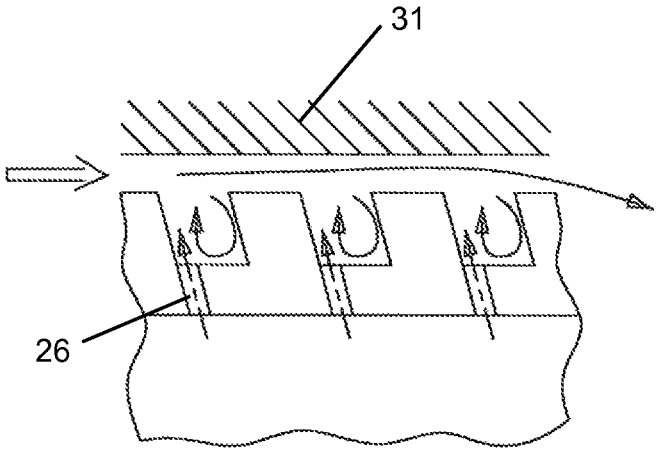
FIG. 8 shows a cross section view of the blade tip cooling circuit of the present invention with the cooling air injection inline with the secondary flow.
Figure 9:
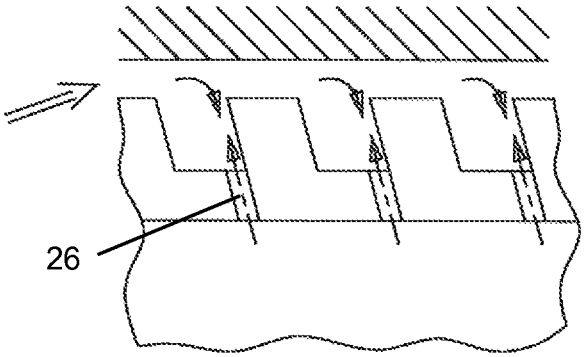
FIG. 9 shows a cross section view of the blade tip cooling circuit of the present invention with the cooling air injection offset to the secondary flow.

In the FIG. 8 embodiment, the tip cooling holes 26 open on a forward side of the vortex channel and discharge the cooling air at a direction inline with the vortex flow formed by the hot gas leakage flow within the vortex channels. The hot gas leakage flow gap is formed between the blade tips and the BOAS (Blade Outer Air Seal) 31. In a FIG. 9 embodiment, the tip cooling holes 26 open on an aft side of the vortex channels and discharge the cooling air in a direction off-set from the vortex flow.

In each of the embodiments, the ribs have side walls that are slanted toward the pressure side wall. The tip cooling holes are also slanted to discharge cooling air in a direction parallel to the rib slanted side walls.

In operation, due to a pressure gradient across the airfoil from the pressure side to the suction side, the secondary flow near the pressure side surface flows from a lower blade span and upward across the blade tip. As the secondary leakage flow flows across the blade tip, a vortex flow is formed along each of the vortex cooling channels 25. These vortices are formed mainly of the cooling air discharged into the squealer pocket from the tip cooling holes 26. Also, due to a pressure gradient, these vortices will roll along the vortex cooling channels 25 from the airfoil leading edge region toward the trailing edge.

The cooling air discharged into the vortex cooling channels will form a backward flow against the oncoming streamwise leakage flow as well as push the recirculated leakage air out of the blade tip vortex channel. The interaction of the blade leakage flow with the discharged cooling air will push the leakage flow backward by the discharged cooling air from the front side of the vortex channels. The backward flowing cooling air also creates an aerodynamic air curtain to block the leakage flow over the blade tip. In addition to the counter flow action, the multiple vortex channel design with a flat pinch point for the blade tip geometry forces the secondary flow to accelerate through a narrow tip leakage passage which yields a smaller vena contractor that reduces the effective leakage flow area between the blade tip and the BOAS 31. The result of all this is to reduce the blade leakage flow.

Another benefit to the vortex cooling channels in the blade tip region is that the discharged cooling air will remain within the vortex channels longer so that improved tip section cooling occurs. The tip section will also allow for the blade to rub into the BOAS 31 with a flat contact surface and without closing any of the tip cooling holes.

The discharged vortex channel cooling air is then discharged through open slots on the pressure side blade tip peripheral rail. Full film cooling for the blade tip rail is created for the blade tip end cooling. The spent cooling air will then mix with the hot gas leakage flow and flow together over the blade tip section.

The vortex cooling channels in the blade tip section of the present invention creates an effective method for cooling and sealing of the blade tip. the combination effects of the vortex cooling plus cooling air discharge into the vortex cooling channels provides for a very effective cooling and sealing arrangement for the blade tip section. A maximum use of the cooling air is achieved for a given airfoil inlet gas temperature and pressure profile. Also, the multiple discharge of cooling air with the spent cooling air recirculation within the vortex cooling channels generates a high coolant flow turbulence level to yield a higher internal convection cooling effectiveness. The cooling flow discharged into the vortex cooling channels creates a very high resistance for the leakage flow and the narrow vortex channels provides for shorter leakage flow oaths that reduce the blade leakage flow. Thus, the blade tip metal temperature can be reduced without additional cooling air flow.

I claim the following:

1. A turbine rotor blade comprising: an airfoil section with a pressure side wall and a suction side wall; a blade tip section with a pressure side tip rail and a suction side tip rail forming a squealer pocket; a plurality of chordwise extending ribs formed within the squealer pocket; the plurality of chordwise extending ribs forming a plurality of vortex cooling air channels; the plurality of vortex cooling air channels each having an inlet end that opens into the squealer pocket in a leading edge region of the blade tip section; the plurality of vortex cooling air channels each having an outlet end that opens in a slot on the pressure side tip peripheral wall; and, the plurality of vortex cooling air channels each has a row of tip cooling holes opening into the respective vortex cooling air channel.

2. The turbine rotor blade of claim 1, and further comprising:

the pressure and suction side tip rails and the chordwise extending ribs have the same radial height.

3. The turbine rotor blade of claim 1, and further comprising:

the plurality of vortex cooling air channels have side walls that are slanted toward the pressure side wall.

4. The turbine rotor blade of claim 1, and further comprising:

the tip cooling holes open into the vortex cooling air channels in a middle of the vortex cooling air channel.

5. The turbine rotor blade of claim 1, and further comprising:

the tip cooling holes open into the vortex cooling air channels along a forward side of the vortex cooling air channel.

6. The turbine rotor blade of claim 1, and further comprising:

the tip cooling holes open into the vortex cooling air channels along an aft side of the vortex cooling air channel.

7. The turbine rotor blade of claim 1, and further comprising:

the rows of tip cooling holes extend along the entire vortex cooling air channels from the inlet end to a discharge end.

* * * * *